US009095035B2

(12) United States Patent
Nam

(10) Patent No.: US 9,095,035 B2
(45) Date of Patent: Jul. 28, 2015

(54) DISPLAY DEVICE, INVERTER APPARATUS AND METHOD OF DRIVING LAMPS

(75) Inventor: Kwang-woo Nam, Seoul (KR)

(73) Assignee: ROHM CO., LTD. (JP)

( * ) Notice: Subject to any disclaimer, the term of this patent is extended or adjusted under 35 U.S.C. 154(b) by 300 days.

(21) Appl. No.: 13/268,163

(22) Filed: Oct. 7, 2011

(65) Prior Publication Data

US 2013/0088163 A1 Apr. 11, 2013

(51) Int. Cl.
*H05B 37/00* (2006.01)
*H05B 41/282* (2006.01)
*G09G 3/34* (2006.01)

(52) U.S. Cl.
CPC ..... *H05B 41/2827* (2013.01); *G09G 3/342* (2013.01)

(58) Field of Classification Search
CPC ..... G09G 3/3406; G09G 3/342; G09G 2310/024; G09G 2310/08; G09G 2320/0247; G09G 3/3648; G09G 2320/062; G09G 2330/02; G09G 2330/021; G09G 3/3413; G09G 3/36; H05B 41/282; H05B 41/2881; H05B 41/29
USPC ..... 315/312–349, 219
See application file for complete search history.

(56) References Cited

U.S. PATENT DOCUMENTS 7,741,784 B2 * 6/2010 Paeng et al. ..... 315/90
8,149,205 B2 * 4/2012 Yu et al. ..... 345/102
2004/0232853 A1 * 11/2004 Hur et al. ..... 315/291
2005/0083294 A1 * 4/2005 Kim et al. ..... 345/102
2006/0119294 A1 * 6/2006 Oh et al. ..... 315/312
2008/0122781 A1 * 5/2008 Namki ..... 345/102
2009/0115341 A1 * 5/2009 Nijhof et al. ..... 315/246
2009/0154202 A1 * 6/2009 Takatsuka et al. ..... 363/40
2009/0243491 A1 * 10/2009 Iwai ..... 315/116

FOREIGN PATENT DOCUMENTS

KR 1020050037393 A 4/2005
KR 1020080013075 A 2/2008
KR 1020080110232 A 12/2008

OTHER PUBLICATIONS

Korean Office Action "Notice of Preliminary Rejection" for Korean Patent Application No. 10-2009-33090; Date of Mailing: Aug. 25, 2014, with English translation.

* cited by examiner

*Primary Examiner* — Douglas W Owens
*Assistant Examiner* — Monica C King
(74) *Attorney, Agent, or Firm* — Cantor Colburn LLP

(57) ABSTRACT

A display device including two or more lamp groups, each having one or more lamps, includes a driving control signal generating unit and an inverter unit. The driving control signal generating unit generates driving control signals to control the driving of at least one of the two or more lamp groups. The inverter apparatus includes two or more inverter circuits configured to receive the driving control signals. In the display device, each of the two or more inverter circuits sets the operation frequency of a corresponding lamp group based on the driving control signals, and generates an operation voltage for the corresponding lamp group according to the set operation frequency.

6 Claims, 4 Drawing Sheets

DISPLAY DEVICE, INVERTER APPARATUS AND METHOD OF DRIVING LAMPS

TECHNICAL FIELD

The present disclosure relates to an inverter apparatus for driving lamps of a display device provided with a plurality of lamp groups and a method of driving the lamps.

BACKGROUND

With the advancement of information technology, the importance of display devices as information transfer media is increasing. In the field of display devices, requirements for large size, light weight, thin thickness, high image quality, etc. are gradually increasing in accordance with the advancement of technology. In order to satisfy these requirements, liquid crystal displays (LCDs) are widely used instead of conventional cathode ray tubes (CRTs).

A liquid crystal display device generally includes a substrate having pixels formed in a matrix, an opposing substrate, and a liquid crystal material with an anisotropic dielectric constant injected between the two substrates. In the liquid crystal display device, an electric field is applied between the two substrates, and the intensity of the applied electric field is adjusted, so that the amount of light passing through the liquid crystal material is controlled, thereby displaying a desired image. If a voltage is applied to liquid crystals through pixel electrodes provided to the respective pixels of the liquid crystal display device, alignment of the liquid crystals is changed accordingly, and diffraction is caused while light passes through the liquid crystals whose alignment is changed, thereby obtaining a desired image. Since a liquid crystal display device is not a self-luminescent display device, the liquid crystal display device is configured such that a lamp mounted on the back of the liquid crystal display device operates as a light source.

Generally, a liquid crystal display device has a plurality of lamps. In the liquid crystal display device, image signals which take up an entire screen during a single frame period are sequentially inputted and displayed on the screen when the screen is changed. At this time, an appropriate response time for realigning the liquid crystals is required to change the image according to a change in the inputted image signals, and hence there may be a degradation of image quality, since an afterimage of the previous screen may remain on a newly displayed screen when the liquid crystals are being realigned. A liquid crystal display device having a plurality of lamps may employ a scanning method to divide the plurality of lamps into a plurality of lamp groups and to control the lamp groups to be sequentially turned on, in order to become more energy efficiency and to prevent the degradation of display quality. When the scanning method is employed, the luminance of a display image may be increased by partially overlapping turned-on periods of neighboring lamp groups with one another. When the lamps are divided into two or more lamp groups and the driving of each of the lamp groups is controlled according to the scanning method, the liquid crystal display device may include an inverter circuit for controlling driving of each of the lamp groups.

A turned-on lamp may generate parasitic capacitance between the turned-on lamp and another turned-on lamp adjacent thereto on a panel. When driving is controlled for each of the lamp groups using a scanning method, particularly in a control method where turned-on periods of neighboring lamp groups partially overlap one another, only one lamp group may be turned on, or two or more neighboring lamp groups may be turned on together, depending on the time period. Therefore, during a time period in which only one lamp group is turned on, parasitic capacitance may be generated by turned-on lamps belonging to a corresponding lamp group. Alternatively, during the time period in which two or more lamp groups are turned on together, parasitic capacitance may be generated by turned-on lamps belonging to the corresponding two or more lamp groups. Accordingly, the parasitic capacitance generated by the turned-on lamps in the liquid crystal display device changes depending on the time period in which only one lamp group is turned on or two or more lamp groups are turned on.

In relation to this, the operation of the inverter circuits for controlling driving of the respective lamp groups will be described. The inverter circuit converts a DC voltage supplied from outside the liquid crystal display device into an appropriate AC voltage based on a corresponding driving control signal received from the outside, i.e., a signal for controlling turn-on of a corresponding lamp group. Then, the inverter circuit transforms the converted AC voltage into an appropriate operation voltage and supplies the transformed operation voltage to the corresponding lamp group. The operation voltage outputted from the inverter circuit and supplied to the lamps belonging to the corresponding lamp group is determined based on a resonance frequency and an operation frequency of the inverter circuit. Generally, the operation frequency is an arbitrarily fixed value determined when designing the inverter circuit, and the resonance frequency ($f_r$) becomes $1/(2\pi\sqrt{LC})$. While L is a fixed value determined based on a physical structure of the inverter circuit, C may be change in value depending on a change in the parasitic capacitance generated by the turned-on lamps described above. Therefore, a change in the entire parasitic capacitance of the liquid crystal display device generated depending on the change in the number of turned-on lamp groups causes a change in the resonance frequency ($f_r$), and the change in the resonance frequency ($f_r$) generated while the operation frequency is fixed causes a change in the output operation voltage of the inverter circuit. In other words, the change in the entire parasitic capacitance of the liquid crystal display device caused when the number of turned-on lamp groups is changed in each time period causes a change in the resonance frequency ($f_r$) of the inverter circuit for controlling turn-on of each of the lamp groups, and accordingly, a lamp driving voltage outputted from the inverter circuit is changed. The operation voltage change depends on the change in the resonance frequency ($f_r$) which causes distortion of a current waveform supplied to the lamps, and therefore, the screen may flicker.

Accordingly, development of a lamp driving method and apparatus of an liquid crystal display device that enables stable lamp driving regardless of a change in a parasitic capacitance generated by a change in the number of turned-on lamp groups is desired, so as to cope with a change in the resonance frequency of an inverter apparatus for controlling turn-on of the lamps in the liquid crystal display device.

SUMMARY

The present disclosure provides some embodiments of a lamp driving method and apparatus in a liquid crystal display device having a plurality of lamp groups, which enables stable lamp driving regardless of a change in a parasitic capacitance generated by turned-on lamps as the number of turned-on lamp groups is changed, when driving of each of the lamp groups is controlled according to a scanning method so that turned-on periods of neighboring lamp groups partially overlap with one another.

According to one aspect of the present disclosure, provided is a display device including two or more lamp groups, each having one or more lamps. The display device includes a driving control signal generating unit configured to generate driving control signals for controlling the driving of the respective two or more lamp groups; and an inverter apparatus including two or more inverter circuits configured to receive the driving control signals. Each of the two or more inverter circuits sets an operation frequency of a corresponding lamp group based on the driving control signals, and generates an operation voltage for the corresponding lamp group according to the set operation frequency.

According to an embodiment of the present disclosure, the generated operation voltages may be substantially identical to each other in time periods in which the two or more lamp groups are respectively turned on.

According to another aspect of the present disclosure, provided is an inverter apparatus for individually supplying an operation voltage to first and second lamp groups in a display device including the first and second lamp groups. The inverter apparatus includes a first inverter circuit configured to set a first operation frequency for the first lamp group so as to control an operation voltage for the first lamp group to be maintained as a first value at a time period in which the first lamp group is turned on, wherein the first inverter circuit outputs the first value at the set first operation frequency; and a second inverter circuit is configured to set a second operation frequency for the second lamp group so as to control an operation voltage for the second lamp group to be maintained as a second value at a time period in which the second lamp group is turned on, wherein the second inverter circuit outputs the second value at the set second operation frequency.

According to an embodiment of the present disclosure, the first and second values may be identical to each other.

According to an alternate embodiment of the present disclosure, when the first lamp group is in an on-state and the second lamp group is in an off-state during a first time period, the first inverter circuit may receive driving control signals for controlling the driving of the first and second lamp groups for a second time period after the first time period, and the first inverter circuit may decrease the first operation frequency for the first lamp group during the second time period so that the operation voltage for the first lamp group is maintained as the first value during the second time period if the received signals indicate that the first lamp group maintains the on-state and the second lamp group switches to the on-state during the second time period.

According to another embodiment of the present disclosure, the first inverter circuit may decrease the first operation frequency to a value set based on a change in a resonance frequency for the first lamp group during the second time period.

According to another alternate embodiment of the present disclosure, the second inverter circuit may receive driving control signals for controlling the driving of the first and second lamp groups for a third time period after the second time period, and increase the second operation frequency for the second lamp group during the third time period so that the operation voltage for the second lamp group is maintained at the second value during the third time period if the received signals indicate that the first lamp group switched to the off-state and the second lamp group maintains the on-state during the third time period.

According to another embodiment of the present disclosure, the second inverter circuit may increase the second operation frequency to a value set based on a change in a resonance frequency for the second lamp group during the third time period.

According to an alternate embodiment of the present disclosure, the inverter apparatus may drive the first and second lamp groups using a scanning method, and the first and second lamp groups may be adjacent to each other on the display device.

According to another alternate embodiment of the present disclosure, the first and second inverter circuits may include two or more resistors connected in parallel so as to set the first and second operation frequencies.

According to another embodiment of the present disclosure, the inverter apparatus may include two or more capacitors connected in parallel so as to set the first and second operation frequencies.

According to a further aspect of the present disclosure, provided is a method of controlling driving of first and second lamp groups in a second time period after a first time period in which the first lamp group is in an on-state and the second lamp group is in an off-state, in a display device including the first and second lamp groups. The method includes receiving a driving control signal for the second time period; and decreasing an operation frequency for the first lamp group during the second time period so that an operation voltage for the first lamp group during the second time period is substantially identical to that during the first time period if the received driving control signal indicates that the first lamp group stays in the on-state and the second lamp group switches to the on-state during the second time period.

According to still a further aspect of the present disclosure, provided is a method of controlling driving of first and second lamp groups in a second time period after a first time period in which both first and second lamp groups are in an on-state, in a display device including the first and second lamp groups. The method includes receiving a driving control signal for the second time period; and increasing an operation frequency for the second lamp group during the second time period so that an operation voltage for the second lamp group during the second time period is substantially identical to that during the first time period if the received driving control signal indicates that the first lamp group switches to an off-state and the second lamp group stays in the on-state during the second time period.

DETAILED DESCRIPTION

Hereinafter, exemplary embodiments of the present disclosure will be described in detail with reference to the accompanying drawings. In the following description, detailed explanation of known related functions and constitutions may be omitted to avoid unnecessarily obscuring the subject manner of the present disclosure. The following description is merely an embodiment of the present disclosure, and it should be understood that the present disclosure is not limited thereto.

Figure 1:
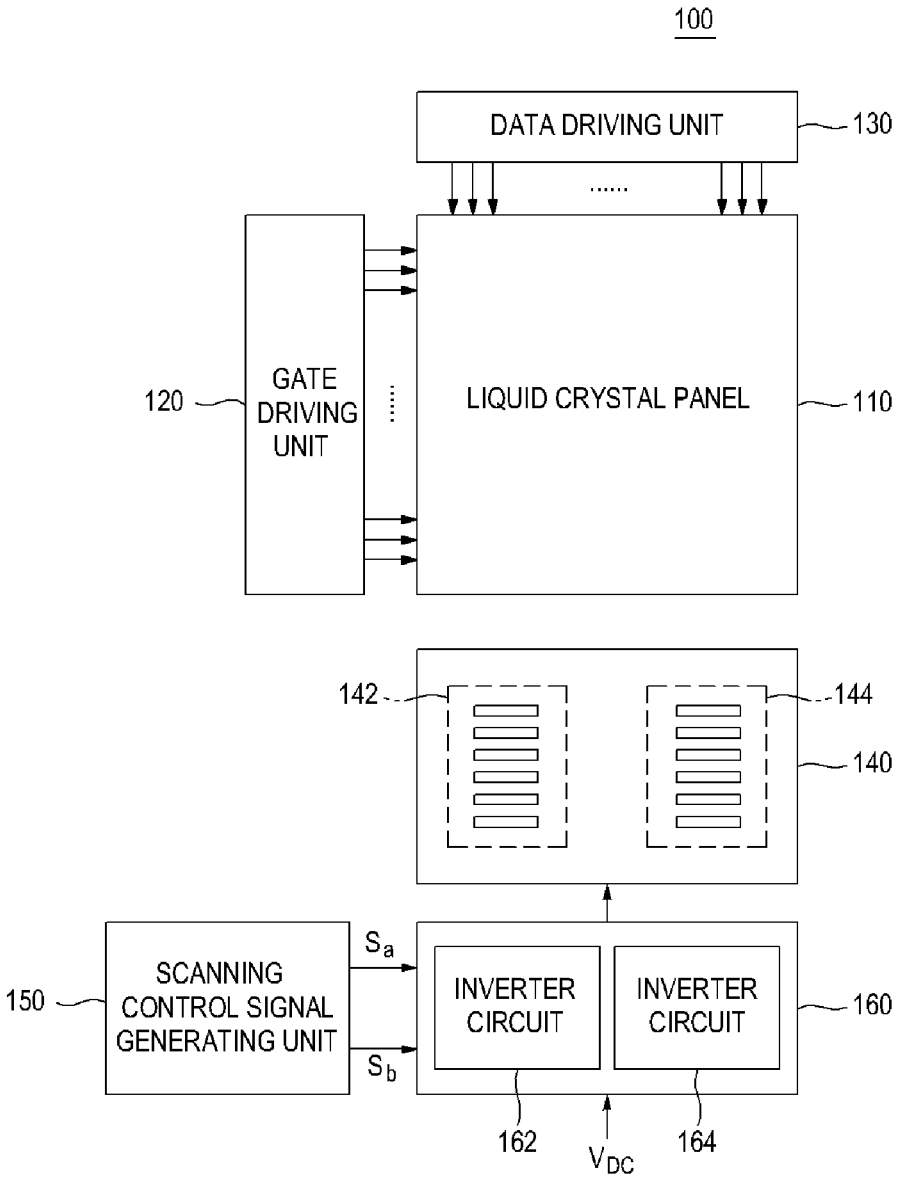
FIG. 1 is a block diagram schematically showing a configuration of a liquid crystal display device to which the present disclosure is applicable.

FIG. 1 is a block diagram schematically showing a configuration of a liquid crystal display device 100 to which the present disclosure is applicable.

As shown in this figure, the liquid crystal display device 100 includes a liquid crystal panel 110, a gate driving unit 120, a data driving unit 130, a lamp unit 140, a driving control signal generating unit 150 and an inverter unit 160.

The liquid crystal panel 110 includes a pixel substrate having pixel patterns arranged in a matrix. A plurality of gate lines and a plurality of data lines intersecting to be perpendicular to each of the gate lines are formed on the pixel substrate, and pixels are respectively formed at intersection points of the gate and data lines. Each of the pixels includes a thin film transistor having gate and source electrodes respectively connected to one gate line and one data line, and a pixel electrode is connected to a drain electrode of the thin film transistor. If an electrical signal is applied to the gate electrode of the thin film transistor through the gate line and an electrical signal is applied to the source electrode of the thin film transistor through the data line, the thin film transistor is turned on according the input of these electrical signals so as to output an electrical signal for displaying an image to the drain electrode and the pixel electrode connected thereto.

The gate driving unit 120 is a circuit that sequentially applies a gate voltage to the plurality of gate lines arranged on the liquid crystal panel 110 so that the gate lines can be sequentially selected. The gate driving unit 120 sequentially scans each of the gate lines by a unit of one horizontal scanning period based on a horizontal synchronization signal (Hsync). That is, the gate driving unit 120 applies a gate-on voltage to one gate line selected from the plurality of gate lines during one horizontal scanning period and applies a gate-off voltage to the other gate lines at the same time. The gate driving unit 120 sequentially performs the scanning process for all the gate lines. If the gate-on voltage is applied to the gate line, thin film transistors of the pixels connected to the gate line are in a turned-on state.

The data driving unit 130 is a circuit that applies a data voltage for displaying an image to the plurality of data lines arranged on the liquid crystal panel 110. The data driving unit 130 sequentially latches image data inputted from the outside of the liquid crystal display device 100 and changes the latched image data into data of a scan line unit. Then, the data driving unit 130 generates a grayscale voltage signal according to the image data of the scan line unit and applies the generated grayscale voltage signal to the data lines on the liquid crystal panel 110 one horizontal scanning period at a time. The grayscale voltage signal supplied to each of the data lines from the data driving unit 130 is applied to the source electrodes of the thin film transistors of the pixels, which are turned on by receiving the gate voltage applied from the gate driving unit 120, and then supplied to the pixel electrodes. Accordingly, a predetermined operation of displaying an image is performed. As described above, the data driving unit 130 applies the grayscale voltage signal for displaying an image to each of the data lines one horizontal scanning period at a time, and the operation is repeatedly performed during one frame based on one vertical synchronization signal (Vsync).

The lamp unit 140 is disposed below the pixel substrate of the liquid crystal panel 110 so as to operate as a light source of the liquid crystal display device 100. The lamp unit 140 may be one of various types of lamps such as a cold cathode fluorescent lamp (CCFL), an external electrode fluorescent lamp (EEFL), a light emitting diode (LED) and a flat fluorescent lamp (FFL). The lamp unit 140 includes a plurality of lamps and can be divided into a plurality of lamp groups including one or more lamps. As shown in this figure, the lamp unit 140 includes two lamp groups 142 and 144, and each of the lamp groups 142 and 144 includes six lamps. However, the number of lamp groups constituting the lamp unit 140 or the number of lamps included in each of the lamp groups 142 and 144 is provided only for illustrative purposes, and the present disclosure is not limited thereto.

The driving control signal generating unit 150 generates driving control signals Sa and Sb for respectively controlling the sequential turn-on of the two lamp groups 142 and 144. The scanning control signals Sa and Sb are signals for determining on/off states of the lamp groups 142 and 144, respectively. In one embodiment, the driving control signal Sa has an on-level in a time period in which the lamp group 142 is turned on. Similarly, in one embodiment, the scanning control signal Sb has an on-level in a time period in which the lamp group 144 is turned on.

The inverter unit 160 receives a DC voltage signal $V_{DC}$ supplied from the outside thereof. The inverter unit 160 receives the driving control signals Sa and Sb of the lamp groups 142 and 144 from the driving control signal generating unit 150 and generates operation voltage signals necessary for controlling turn-on of the lamp groups 142 and 144 based on the received driving control signals Sa and Sb. As shown in this figure, the inverter unit 160 includes two inverter circuits 162 and 164 for respectively controlling driving of the two lamp groups 142 and 144. According to one embodiment of the present disclosure, each of the inverter circuits 162 and 164 in the inverter unit 160 is configured to generate an AC voltage signal of a predetermined operation frequency based on the driving control signals Sa and Sb inputted at every time period.

Figure 2:
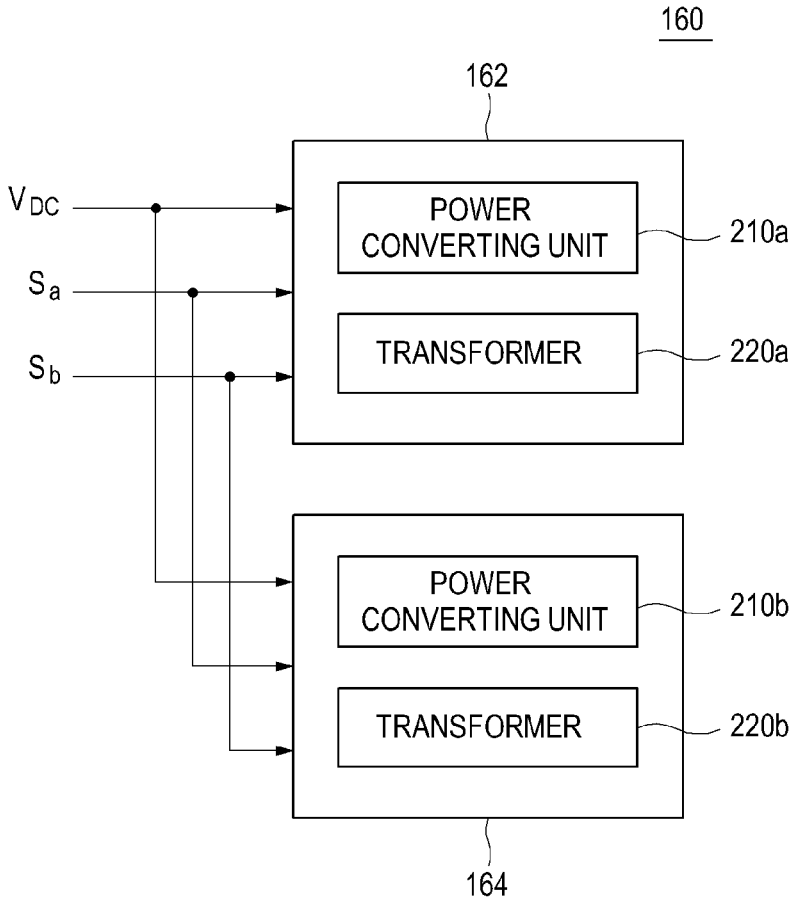
FIG. 2 is a block diagram showing a detailed configuration of an inverter unit shown in FIG. 1.

FIG. 2 is a block diagram showing a detailed configuration of the inverter unit 160 shown in FIG. 1. As shown in FIG. 2, the inverter unit 160 includes the two inverter circuits 162 and 164 for controlling driving of the lamp groups 142 and 144, respectively. The inverter circuits 162 and 164 include power converting units 210*a* and 210*b* and transformers 220*a* and 220*b*, respectively.

Each of the power converting units 210*a* and 210*b* receives the DC voltage signal $V_{DC}$ supplied from the outside thereof and the driving control signals Sa and Sb for driving the two lamp groups 142 and 144. Each of the power converting units 210*a* and 210*b* may set an operation frequency to be used in a corresponding time period to an appropriate value, based on the received driving control signals Sa and Sb. As described above, the driving control signals Sa and Sb received in each time period indicate the number of lamp groups turned on in a corresponding time period, and a change in parasitic capacitance of the liquid crystal display device is generated depending on a change in the number of lamp groups turned on during each of the time periods. The change in the parasitic capacitance of the liquid crystal display device may cause a change in the resonance frequency ($f_r$) of each of the inverter circuits 162 and 164. Here, the operation frequency set by each of the power converting units 210*a* and 210*b* based on the driving control signals Sa and Sb received during an arbitrary time period may be a value determined in correspondence to the change in the parasitic capacitance generated depending on the number of lamp groups turned on during a corresponding time period and the change in the resonance frequency ($f_r$) according to the change in the parasitic capacitance. According to one embodiment of the present disclosure, the change in the resonance frequency ($f_r$) generated depending on the change in the number of turned-on lamp groups may be an experimentally obtained value, and the power converting units 210*a* and 210*b* may set the operation frequency to a predetermined frequency based on the change in the resonance frequency ($f_r$) experimentally obtained as described above. The power converting units 210*a* and 210*b* may convert the DC voltage signal $V_{DC}$ received from outside during a corresponding time period into AC voltage signals $V_{ACa}$ and $V_{ACb}$ based on the operation frequency set for each of the time periods.

The transformers 220*a* and 220*b* receives the AC voltage signals $V_{ACa}$ and $V_{ACb}$, respectively. Then, the transformers 220*a* and 220*b* transform the received AC voltage signals $V_{ACa}$ and $V_{ACb}$ into operation voltages for controlling driving of the lamp groups 142 and 144 based on a predetermined voltage ratio and supply the transformed operation voltages to the corresponding lamp groups 142 and 144, respectively. According to one embodiment of the present disclosure, the output operation voltage supplied to the lamp group 142 from the transformer 220*a* can be maintained constant at each time period in which the lamp group 142 is turned on. Similarly, the output operation voltage supplied to the lamp group 144 from the transformer 220*b* can be maintained constant at each time period in which the lamp group 144 is turned on. As described above, the parasitic capacitance of the liquid crystal display device can be changed depending on the change in the number of lamp groups turned on in each of the time periods, and accordingly, the resonance frequency ($f_r$) of each of the inverter circuits 162 and 164 can be changed. However, since the operation frequency of each of the inverter circuits 162 and 164 is variably set as much as the amount corresponding to the change in the resonance frequency ($f_r$), the output operation voltage can be maintained constant.

Although not shown in detail in FIG. 2, according to one embodiment of the present disclosure, each of the inverter circuits 162 and 164 may have an internal circuit for appropriately setting the operation frequency based on the received driving control signals Sa and Sb. According to one embodiment of the present disclosure, the circuit may be configured to include two or more resistors connected in parallel or two or more capacitors connected in parallel between an operation frequency determination terminal and input terminals of the signals Sa and Sb. As is well known in the art, if resistors are connected in parallel, the total value of resistance is decreased, and therefore, the frequency of the circuit is increased. If the circuit includes two or more resistors connected in parallel between the operation frequency determination terminal and the input terminals of the signals Sa and Sb, the operation frequency can be increased. Further, as is well known in the art, if capacitors are connected in parallel, the total value of capacitance is increased, and therefore, the frequency of the circuit is decreased. If the circuit includes two or more capacitors connected in parallel between the operation frequency determination terminal and the input terminals of the signals Sa and Sb, the operation frequency can be decreased. However, the present disclosure is not limited thereto, and it can be understood by those skilled in the art that the circuit for changing the operation frequency may be configured in various ways.

Figure 3:
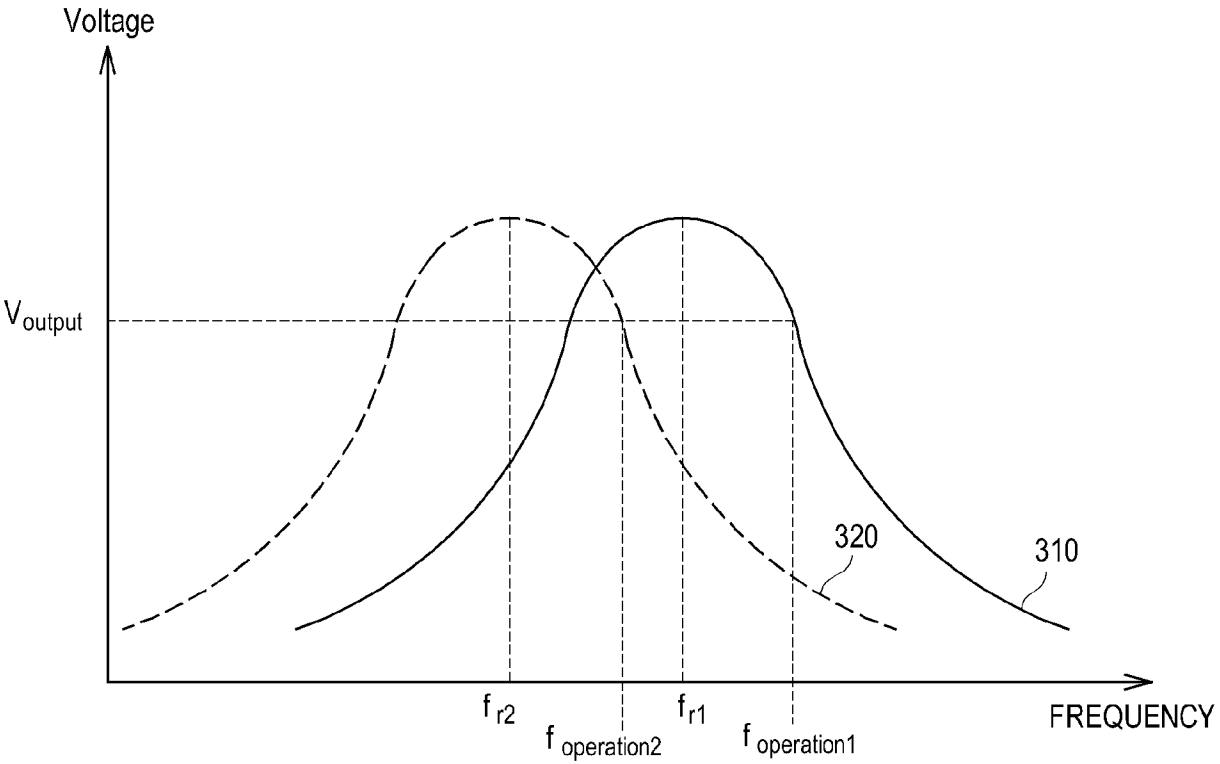
FIG. 3 is a graph showing changes in resonance and operation frequencies generated in an inverter circuit shown in FIG. 2, when the number of turned-on lamp groups is changed, according to an embodiment of the present disclosure.

FIG. 3 is a graph showing changes in resonance and operation frequencies generated in the inverter circuit 162 shown in FIG. 2, when the number of turned-on lamp groups is changed, according to an embodiment of the present disclosure.

In FIG. 3, a frequency-voltage characteristic graph is shown by a solid line 310. Here, in relation to the inverter circuit 162 shown in FIG. 2, the frequency-voltage characteristic graph shows a relation between resonance and operation frequencies of the inverter circuit 162 and an output operation voltage according to the resonance and operation frequencies, when only the lamp group 142 is turned on. According to the frequency-voltage characteristic graph 310, as the frequency starts from zero and then increases, the output operation voltage of the inverter circuit 162 gradually increases and has a maximum output voltage at a predetermined frequency. Then, as the frequency increases further above the predetermined frequency, the output operation voltage of the inverter circuit 162 gradually decreases. In this case, the frequency when the output operation voltage of the inverter circuit 162 has the maximum value corresponds to a resonance frequency $f_{r1}$. According to the frequency-voltage characteristic graph 310, the operation frequency of the inverter circuit 162 is set to a frequency $f_{operation1}$ in consideration of product characteristics. Thus, the output operation voltage of each of the inverter circuits 162 and 164 is determined to be voltage $V_{output}$ based on the resonance frequency $f_{r1}$ and the operation frequency $f_{operation1}$.

In FIG. 3, another frequency-voltage characteristic graph is shown by a dotted line 320. Here, in relation to the inverter circuit 162 shown in FIG. 2, the frequency-voltage characteristic graph 320 shows a relation between resonance and operation frequencies of the inverter circuit 162 and an output operation voltage according to the resonance and operation frequencies, when the neighboring lamp group 144 is additionally turned on while the lamp group 142 is turned on. As shown in this figure, the frequency-voltage characteristic graph 320 is formed by moving the frequency-voltage characteristic graph 310 to the left by a predetermined distance. According to the frequency-voltage characteristic graph 320, the resonance frequency at which the output operation voltage of the inverter circuit 162 has a maximum value corresponds to a frequency $f_{r2}$, and the frequency $f_{r2}$ is smaller than the frequency $f_{r1}$. This is because the state of turning on one lamp group 142 is changed into the state of turning on the two lamp groups 142 and 144. In this case, the parasitic capacitance of the circuit increases, and accordingly, the resonance frequency decreases. According to the present disclosure, as shown in the frequency-voltage characteristic graph 320, the operation frequency of the inverter circuit 162 is changed into a frequency $f_{operation2}$ decreased as much as the amount corresponding to the amount of decrease in the resonance frequency. Thus, the output operation voltage of the inverter circuit 162, which is determined based on the resonance frequency $f_{r2}$ and the operation frequency $f_{operation2}$, is maintained constant to the voltage $V_{output}$, like in the case of the graph 310.

Figure 4:
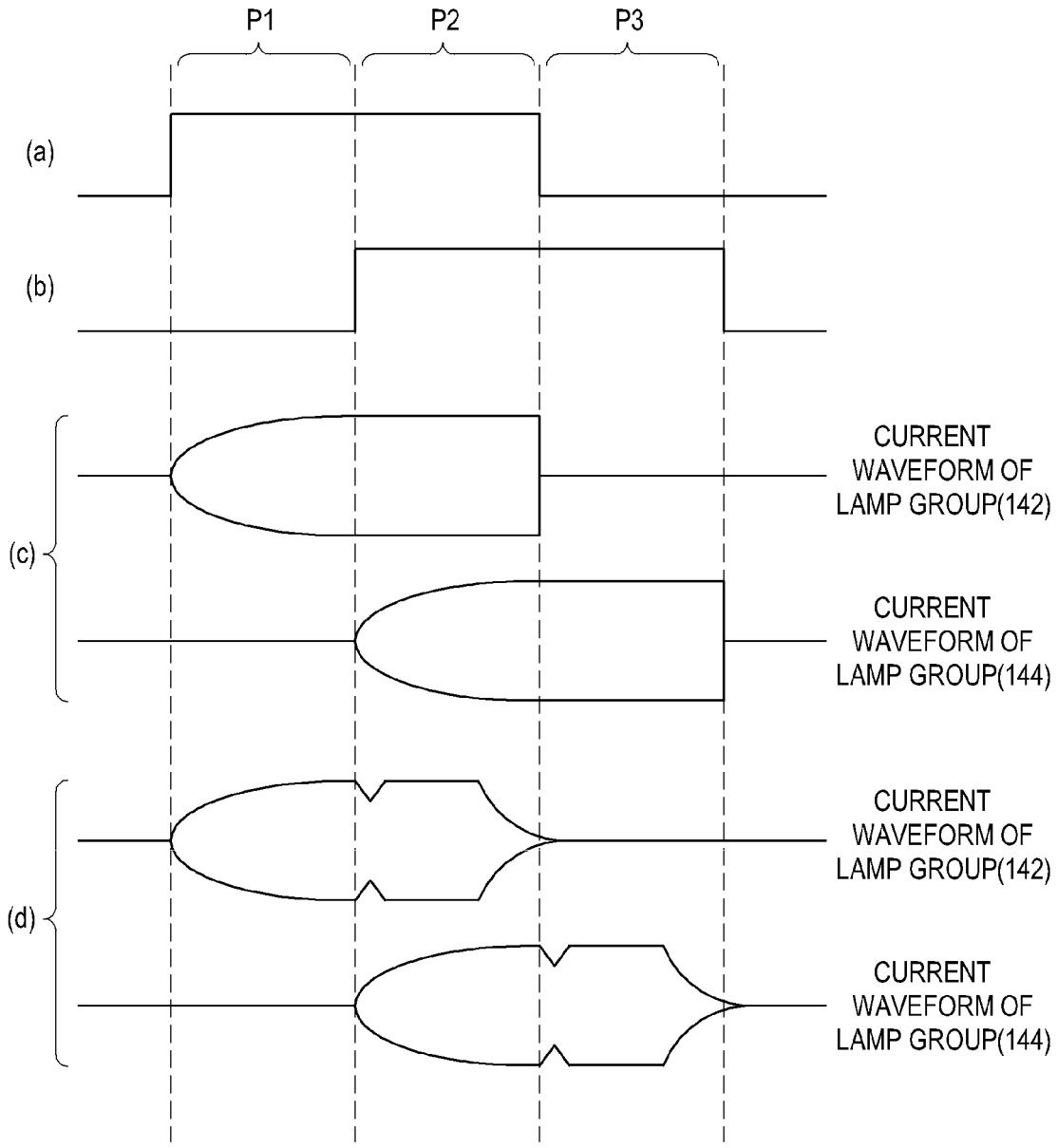
FIG. 4 shows a timing chart of: (a) a driving control signal Sa for controlling driving of a lamp group 142 throughout three time periods of P1 to P3; (b) a driving control signal Sb for controlling driving of a lamp group 144 through the three time periods of P1 to P3; (c) waveforms of current flowing in the respective lamp groups 142 and 144, when the operation frequency is appropriately changed according to the present disclosure; and (d) waveforms of current flowing in the respective lamp groups 142 and 144, when the operation frequency is constantly maintained according to the related art.

FIG. 4(*a*) shows a driving control signal Sa for controlling driving of the lamp group 142 throughout three time periods of P1 to P3. As shown in FIG. 4(*a*), the lamps belonging to the lamp group 142 turn into an on-state at the starting point of the time period P1, maintain the on-state during the time periods P1 and P2, and then turn into an off-state at the starting point of the time period P3.

FIG. 4(*b*) shows a driving control signal Sb for controlling driving of the lamp group 144 through the three time periods of P1 to P3. As shown in FIG. 4(*b*), the lamps belonging to the lamp group 144 maintain an off-state during the time period P1, turn into an on-state at the starting point of the time period P2, and maintain the on-state during the time periods P2 and P3. As shown in FIGS. 4(*a*) and (*b*), only the lamp group 142 is turned on in the time period P1, and all the lamp groups 142 and 144 are turned on in the time period P2. In the time period P3, only the lamp group 144 is turned on.

FIG. 4(*c*) shows waveforms of current flowing in the respective lamp groups 142 and 144, in the case where the operation frequency is appropriately changed when the resonance frequency is changed depending on a change in the number of turned-on lamp groups according to the present disclosure. As shown in this figure, since only the lamp group 142 is turned on in the time period P1, current flows only in the lamp group 142, and the waveform of the current flowing in the lamp group 142 shows a stable state. Then, in the time period P2, the lamp group 144 is newly turned on while the lamp group 142 is kept to be in a turned-on state, and thus current flows in all the lamp groups 142 and 144. In the time period P2, the resonance frequency decreases as the number of turned-on lamp groups is increased compared with that in the time period P1. At this time, the operation frequency of the inverter circuit is appropriately decreased, and thus the waveform of the current flowing in the lamp groups 142 and 144 can show a stable state. Then, only the lamp group 144 maintains a turned-on state in the time period P3, and therefore, current flows only in the lamp group 144. As the number of turned-on lamp groups in the time period P3 is decreased as compared with that in the time period P2, the resonance frequency increases. At this time, the operation frequency of the inverter circuit is appropriately increased, and thus the waveform of the current flowing in the lamp group 144 can still be maintained to be in a stable state.

FIG. 4(*d*) shows waveforms of current flowing in the respective lamp groups 142 and 144, in the case where the operation frequency is constantly maintained even when the resonance frequency is changed depending on a change in the number of turned-on lamp groups according to the related art, unlike the present disclosure. As shown in this figure, since only the lamp group 142 is turned on in the time period P1, current flows only in the lamp group 142, and the waveform of the current flowing in the lamp group 142 shows a stable state. Then, in the time period P2, the lamp group 144 is newly turned on while the lamp group 142 is kept to be in a turned-on state, and thus the current flows in all the lamp groups 142 and 144. As the number of turned-on lamp groups in the time period P2 is increased as compared with that in the time period P1, the resonance frequency is decreased, and the operation frequency is maintained constant. Hence, the output voltage of the transformer in the inverter circuit is decreased, and therefore, the waveform of the current flowing in the lamp group 142 in the time period P2 is distorted, unlike that in the time period P1. The waveform of the current flowing in the lamps belonging to the lamp group 142 shown in the time period P2 is merely an exemplary illustrative form of an unstable and distorted waveform. The lamp group 144 newly turned on in the time period P2 has a current flow of a stable waveform in accordance with the parasitic capacitance at the time point when the two lamp groups 142 and 144 are turned on. Then, in the time period P3, the lamp group 142 is turned off, and only the lamp group 144 maintains the turned-on state. Therefore, the current flows only in the lamp group 144. As the number of turned on lamp groups in the time period P3 is decreased as compared with that in the time period P2, the resonance frequency is increased, and the operation frequency is maintained constant. Hence, the output voltage of the transformer in the inverter circuit is increased, and therefore, the waveform of the current flowing in the lamp group 144 in the time period P3 is distorted, unlike that in the time period P2.

Comparing FIGS. 4(*c*) and (*d*), in the case where the number of the turned-on lamp groups 142 and 144 is changed as time elapses and the turned-on periods of the lamp groups 142 and 144 overlap in a certain period, the waveform of the current flowing in each lamp group can be maintained in the stable state if the operation frequency is appropriately changed in consideration of the change in the parasitic capacitance generated depending on the change in the number of turned-on lamp groups according to the present disclosure, unlike when the operation frequency is constantly maintained.

According to the present disclosure in some embodiments, in a display device having a plurality of lamp groups, when driving of each of the lamp groups is controlled according to a scanning method so that turned-on periods of neighboring lamp groups partially overlap with one another, the lamp driving voltage outputted from a corresponding inverter circuit in each time period in which a corresponding lamp group is turned on can be maintained constant, regardless of a change in parasitic capacitance generated as the number of turned-on lamp groups is changed, in which the parasitic capacitance is generated by the turned-on lamps. Accordingly, it is possible to perform stable lamp driving without flickering.

Although the liquid crystal display device has been mainly described in this specification, the present disclosure is not limited thereto. The present disclosure can be applied to various types of electronic display devices capable of dividing a plurality of light sources into blocks and controlling turn-on of the blocks according to the scanning method.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. An inverter apparatus configured to individually supply an operation voltage to first and second lamp groups included in a display device, the inverter apparatus comprising:

a first inverter circuit configured to receive a driving voltage signal from the outside and first and second scanning control signals for controlling the first and second lamp groups to turn on and off, and to output a first operation voltage signal for a first operation frequency associated with the first scanning control signal, the first inverter including:

a first power converting unit configured to convert the driving voltage signal into the first operation voltage signal based on the first operation frequency which is determined in response to a change in a resonance frequency, wherein the resonance frequency changes based on a number of the first and second lamp groups turned on; and a first transformer configured to transform the first operation voltage signal into an operation voltage for controlling the first lamp group to turn on and off; and a second inverter circuit configured to receive the driving voltage signal and the first and second scanning control signals, and to output a second operation voltage signal for a second operation frequency associated with the second scanning control signal, a second power converting unit configured to convert the driving voltage signal into the second operation voltage signal based on the second operation frequency which is determined in response to the change in the resonance frequency; and a second transformer configured to transform the second operation voltage signal into an operation voltage for controlling the second lamp group to turn on and off, wherein the first operation frequency for the first lamp group is decreased to a predetermined value in response to the change in the resonance frequency when the first and second lamp groups are set to be in an on-state simultaneously in response to the first and second scanning control signals.

2. The inverter apparatus of claim 1, wherein the inverter apparatus drives the first and second lamp groups using a scanning method, and the first and second lamp groups are adjacent to each other on the display device.

3. The inverter apparatus of claim 1, wherein each of the first and second inverter circuits comprises two or more resistors connected in parallel so as to set the first and second operation frequencies.

4. The inverter apparatus of claim 1, wherein each of the first and second inverter circuits comprises two or more capacitors connected in parallel so as to set the first and second operation frequencies.

5. The inverter apparatus of claim 1, wherein the second operation frequency for the second lamp group is increased to a predetermined value in response to the change in the resonance frequency when the first lamp group in the on-state changes to an off-state while maintaining the second lamp group in the on-state.

6. A method of individually supplying an operation voltage to first and second lamp groups included in a display device, the method comprising:

receiving, by a first inverter circuit, a driving voltage signal from an external device and first and second scanning control signals for controlling the first and second lamp groups to turn on and off, and outputting, by the first inverter circuit, a first operation voltage signal for a first operation frequency associated with the first scanning control signal; and receiving, by a second inverter circuit, the driving voltage signal and the first and second scanning control signals, and outputting, by the second inverter circuit, a second operation voltage signal for a second operation frequency associated with the second scanning control signal, wherein the receiving, by the first inverter circuit, includes:

converting the driving voltage signal into the first operation voltage signal based on the first operation frequency which is determined in response to a change in a resonance frequency, wherein the resonance frequency changes based on a number of the first and second lamp groups turned on; and transforming the first operation voltage signal into an operation voltage for controlling the first lamp group to turn on and off, and wherein the receiving, by the second inverter circuit, includes:

converting the driving voltage signal into the second operation voltage signal based on the second operation frequency which is determined in response to the change in the resonance frequency; and transforming the second operation voltage signal into an operation voltage for controlling the second lamp group to turn on and off, and wherein the first operation frequency for the first lamp group is decreased to a predetermined value in response to the change in the resonance frequency when the first and second lamp groups are set to be in an on-state simultaneously in response to the first and second scanning control signals.

* * * * *